United States Patent [19]

Smart et al.

[11] Patent Number: 4,920,859

[45] Date of Patent: May 1, 1990

[54] RADIAL PISTON PUMP AND MOTOR

[75] Inventors: Steven T. Smart; William M. Puls; David L. Hansen, all of Hutchinson, Kans.

[73] Assignee: Eaton Corporaton, Cleveland, Ohio

[21] Appl. No.: 891,892

[22] Filed: Aug. 1, 1986

[51] Int. Cl.[5] ..... F04B 19/02

[52] U.S. Cl. ..... 91/497; 91/486; 91/498

[58] Field of Search ..... 91/497, 498, 486–488; 92/12.1; 417/220, 221

[56] References Cited

U.S. PATENT DOCUMENTS

| | | | |
|---|---|---|---|
| 505,652 | 3/1985 | Burgdorf | 91/498 |
| 3,028,814 | 4/1962 | Rumsey | 92/12.1 |
| 3,695,147 | 10/1972 | Siesennop | 91/498 |
| 4,419,054 | 12/1983 | Sosnowski | 417/221 |
| 4,635,535 | 1/1987 | Thoma | 91/498 |

FOREIGN PATENT DOCUMENTS

| | | | |
|---|---|---|---|
| 2030358 | 12/1971 | Fed. Rep. of Germany | 91/488 |

*Primary Examiner*—Leonard E. Smith

*Attorney, Agent, or Firm*—Edward L. Brown, Jr.

[57] ABSTRACT

A hydraulic radial piston power transmitting assembly including a hoursing and a back plate with a fixed pintle attached to the back plate which rotatably supports a cylinder block with radially spaced bores and pistons therearound, a drive shaft which drives the cylinder block through a coupling means, a cam ring surrounding the cylinder block which is pivotally connected to the housing allowing limited movement of the ring to vary the piston stroke in the cylinder block and cam ring positioning means including a rotating control arm mounted in the housing, swivel means attached to the cam ring with a spherical surface thereon and a sleeve means slidably received on the control arm means including a lateral bore for sliding receipt of the spherical surface of the swivel means to accommodate the locus of points which define the cam ring's various displacement positions.

10 Claims, 4 Drawing Sheets

RADIAL PISTON PUMP AND MOTOR

BACKGROUND OF THE INVENTION

The invention relates to piston pumps and motors and more particularly to the type which is generally referred to in the art as radial piston variable displacement pumps. Radial pumps are distinguished from axial piston pumps in that they position their pistons in a radial pattern in a rotating cylinder block, while in axial piston pumps the pistons reciprocate along axis which are parallel to the axis of rotation of the cylinder block. Radial piston pumps of various types have been in existence for many decades and the state of the art is very refined. The pump displacement is varied by moving the cam ring out of concentric positioning with the rotating cylinder block whereby the pistons and their respective slipper shoes which ride on the inside surface of the cam ring reciprocate as the cylinder block rotates. Some prior art pumps move the cam ring in a lineal path while others pivot the cam ring about a point outside of the ring with some type of actuating means. The pump of the present invention is in the latter category just mentioned, and is pivoted about a pin which passes through the ring itself. The means in the prior art for moving and positioning the cam ring are extensive, as exemplified in the following U.S. Pat. Nos.: 2,566,418; 2,969,022; 2,895,416; 4,526,154.

SUMMARY OF THE INVENTION

The present invention is not only concerned with the mechanism for rotating the cam ring to vary the displacement of the pump, but also includes means for laterally limiting the cam ring within the pump housing so as to minimize wear and chatter. Positioned in a series of pockets in the pump housing are a plurality of floating Nylon pads which provide contact points with the cam ring as the ring is held between the back plate and the pads.

The particular design of the rotating cylinder block in the adjacent structure of the back plate and coupling means permits the leakage oil between the pintle and cylinder block to provide a hydraulic force on the cylinder block for positioning and aligning the cylinder block with its corresponding valving in the pintle.

The mechanism for rotating the cam ring and changing the displacement of the pump includes a rotating control arm which has different radii and planes of rotation from that of the cam ring, which are connected together through a very compact and simple linking structure which involves a universal joint which permits not only rotation but also lineal sliding movement in the same joint.

It is therefore the principal object of the present invention to provide a new and novel cam ring positioning mechanism for radial piston pumps which is compact in size and simple in structure.

Another object of the present invention is to provide a new and novel means for laterally positioning a rotating cylinder block in valving alignment with its pintle.

A further object of the present invention is a means for laterally restraining the cam ring in the pump housing between the back plate and the housing so as to minimize wear and decrease chatter.

Other objects and advantages of the present invention will become more apparent to those skilled in the art from the detailed description which follows with references to the accompanying drawing wherein.

DESCRIPTION OF THE PREFERRED EMBODIMENT OF THE DRAWING

Figure 1:
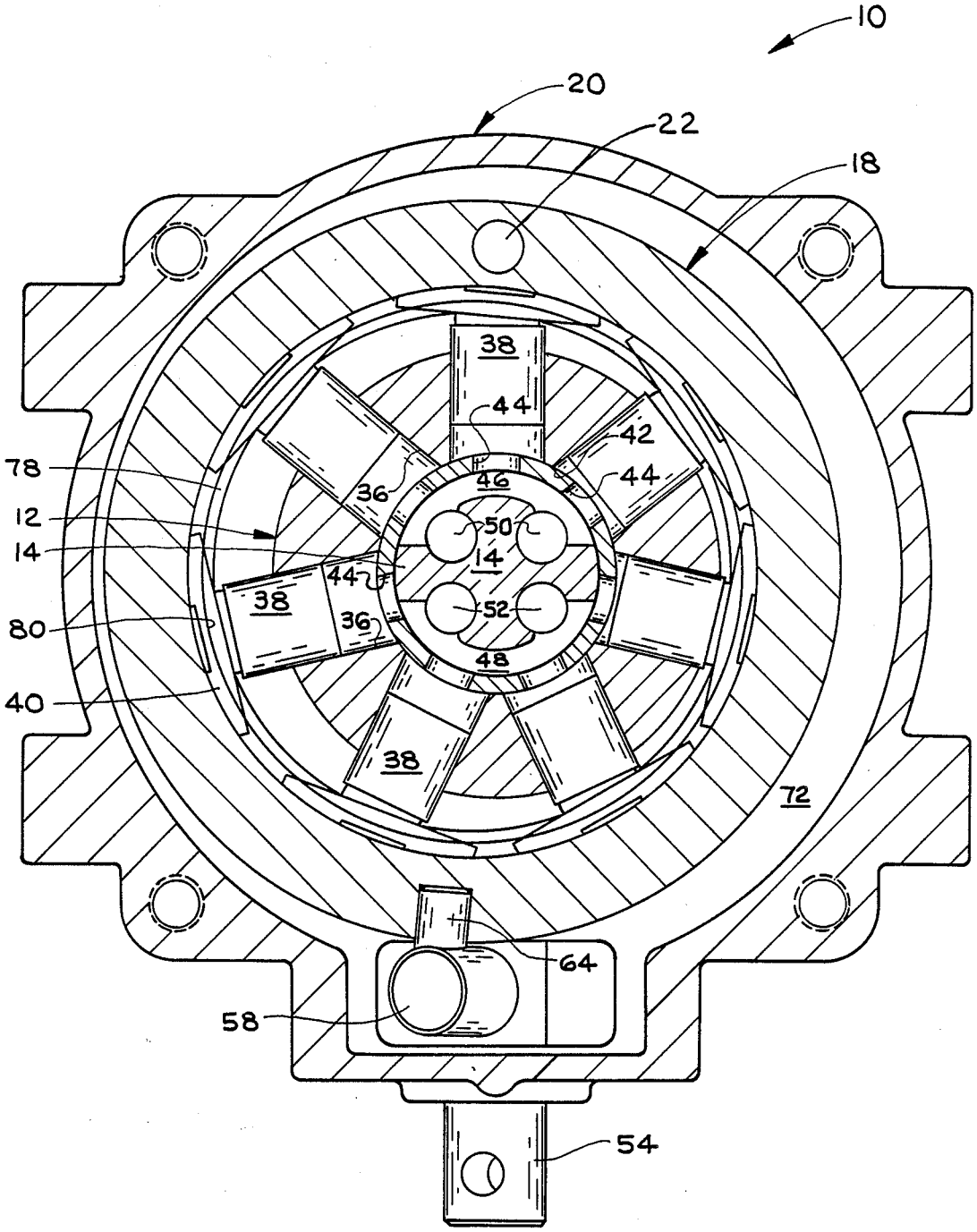
FIG. 1 is a lateral sectional view through the center of the assembly embodying the present invention.
Figure 2:
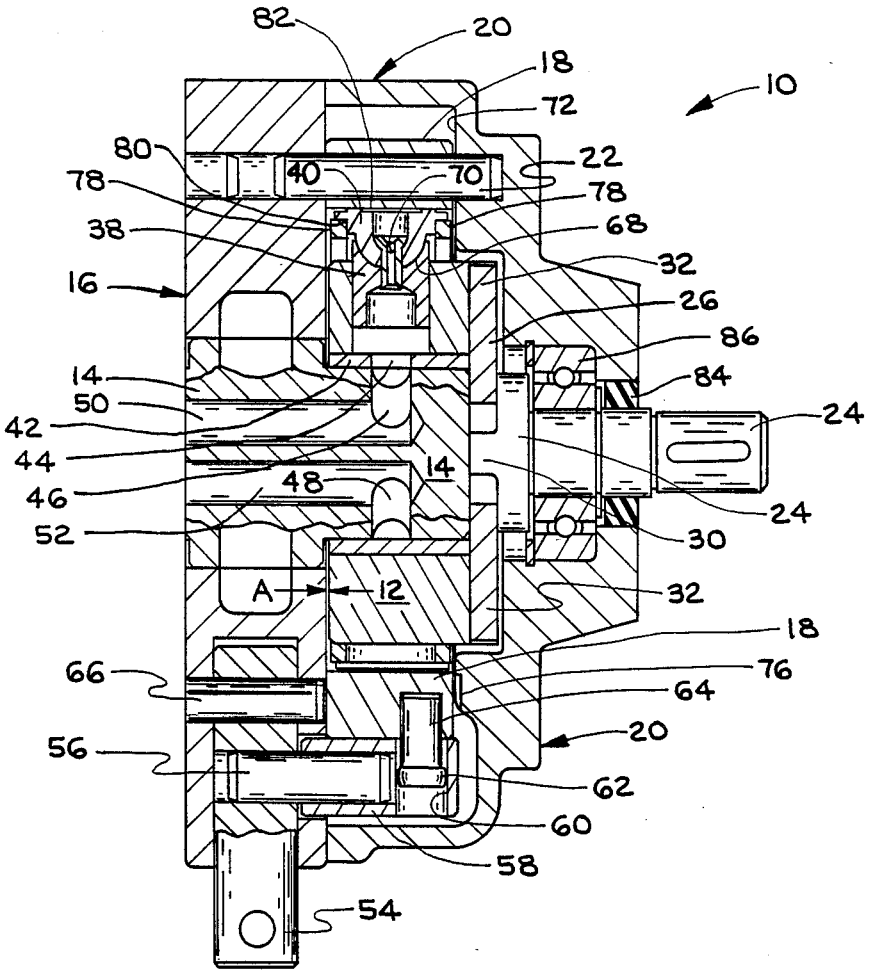
FIG. 2 is a longitudinal sectional view through the assembly.
Figure 3:
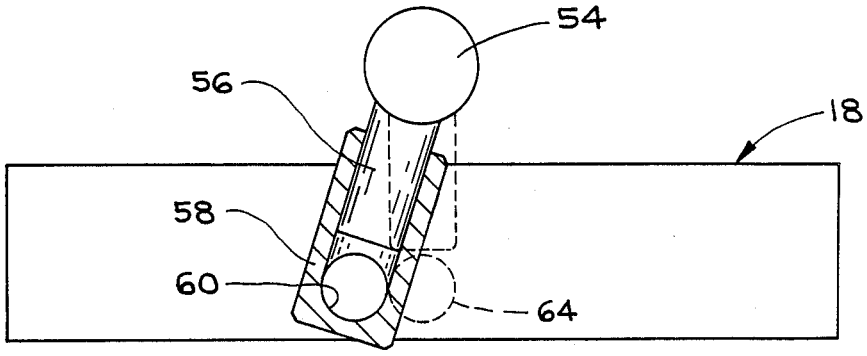
FIG. 3 is a side view to an enlarged scale of the cam ring positioning linkage.
Figure 4:
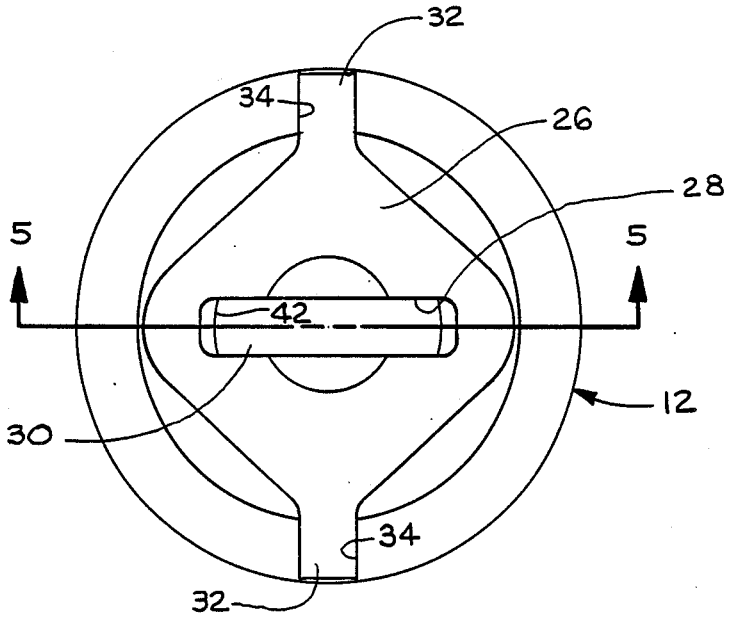
FIG. 4 is a side view of the cylinder block and its drive coupling.
Figure 5:
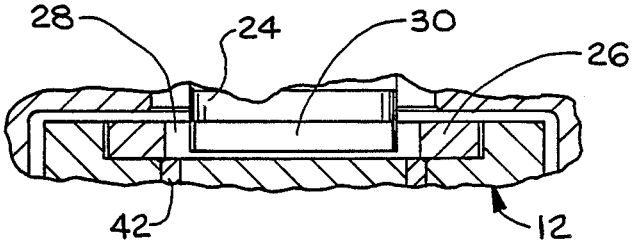
FIG. 5 is a sectional view taken along lines 5—5 of FIG. 4 illustrating the connection between the drive shaft and cylinder block.

With reference to FIGS. 1 and 2 of the drawing, the radial piston pump of the present invention is generally described by reference numeral 10. The pump 10 can also function as a motor as well as being either a variable or fixed displacement unit. The pump 10 comprises a housing 20 connected to a back plate 16, as best seen in FIG. 2. Fixed to back plate 16 is a pintle 14 which rotatably supports a cylinder block 12 while porting the fluid to and from the cylinder block. The cylinder block 12 is driven by a drive shaft 24 through an oldham-type drive couple plate 26. The oldham coupling or drive plate 26 is shown in FIG. 4 and includes a drive slot 28 in the center thereof which is driven by a tang 30, located on the end of drive shaft 24. Drive plate 26 has a pair of lugs 32 oppositely spaced on its outer edge which are slidably received in a pair of lateral slots 34 located in the cylinder block 12. The drive plate 26, while it transmits rotational torque, can slide along two axes, the first being slot 28 and the second being lateral slots 34. With the concentricity tolerance of the drive plate 26, slight misalignments of the drive shaft 24 with the axis of rotation of the cylinder block 12 can be handled without any problem. Drive shaft 24 rotates in a conventional ball bearing 86 which is in turn held in place in housing 20 by a conventional snap ring.

While there is no oil pressure in the housing 20, leakage oil from the cylinder block does collect in the housing, however, seal 84 prevents its leakage around drive shaft 24. Oil leakage within housing 20 is relieved to tank through a well-known conventional case drain not shown in the drawing.

Cylinder block 12 includes a plurality of radially spaced bores 36, as best seen in FIG. 1, which contain pistons 38. Positioned in the center of cylinder block 12 is a sleeve member 42 of soft metal such as brass, which is press-fitted into the block 12 and defines the inside diameter of the cylinder block and rotates on the surface of pintle 14. Located in sleeve 42 are a series of ports 44 which alternately connect with the intake or discharge slots 46 and 48 of the pintle 14. Arcuate intake slot 46, as best seen in FIG. 1, extends approximately 150° around the circumference of pintle 14, and connects with a pair of axial passages 50 which exit the pump 10 through the back plate 16. A similar arcuate discharge slot 48 is located on the opposite side of the pintle, as shown in FIGS. 1 and 2, which joins with a similar pair of axial passages 52 which exit the pump unit 10 adjacent the intake passages 50.

The piston assemblies include a cylindrical piston 38 having a concave ball socket 68 on the outer end thereof for receipt with a mating convex spherical surface on the end of a slipper shoe 40. Both piston 38 and slipper shoe 40 have a center passage therethrough which receives a hollow rivet 70. Rivet 70 of soft metal holds the piston assembly together while allowing a degree of rotational movement between the slipper shoe 40 and the piston 38. The hollow passage in the center of rivet 70 allows the oil pressure in piston bore 36 to act on the ringed area 82 of the slipper shoe 40 between the slipper shoe and the cam ring 18. Pressure in this area 82 urges the slipper shoe against the piston 38.

Surrounding the cylinder block 12 and its seven piston assemblies is a cam ring 18 upon which the slipper shoes 40 slide as the cylinder block rotates. Cam ring 18 is pivotally connected to the pump housing 20 and back plate 16 through a pivot pin 22 thus allowing the cam ring 18 to pivot and vary the stroke of the pistons 38 which thereby changes the volumetric displacement of the pump 10. When cam ring 18 is concentrically positioned along the axis of cylinder block 12, there will be no displacement of the pistons as the cylinder block 12 rotates and consequently no pump discharge.

OPERATION

In viewing FIG. 1, as the cylinder block 12 moves in a counterclockwise direction, the pistons 38 moving across the top of the pump, as seen in FIG. 1, are expanding and sucking oil from intake slot 46. On the intake strokes of the piston, to retain the piston slipper shoes 40 in contact with the inside diameter of cam ring 18, it is required to physically retain the shoes in contact with the cam ring, which, of course, is not necessary on the compression or discharge stroke of the pistons. This is achieved by a pair of steel rings 78, which can be seen in FIGS. 1 and 2, which ride in arcuate grooves 80 in the slipper shoes 40 to hold the slipper shoes in contact with the cam ring 18 during the suction strokes of the pistons.

The mechanism for moving the cam ring 18 to change the displacement of the pump includes a control arm 54 rotatably mounted in back plate 16, as best seen in FIG. 2. Passing through the upper end of arm 54 is a locking pin 66 which retains arm 54 in the back plate and allows it to rotate through a limited arc. Laterally extending from arm 54 is a dowel pin 56 which is in turn received in a connector sleeve 58. Sleeve 58 freely slides on pin 56 and includes a lateral bore 60 through the outer end thereof. Slidably received in bore 60 is a swivel pin 64 having a partially spherical surface 62 located on the end thereof which has a diameter similar to bore 60, thereby providing a swivel joint between swivel pin 64 and connector sleeve 58. Not only can pin 64 swivel with respect to sleeve 58, but it also has lineal movement as the partial ball 62 slides in bore 60.

Figure 6:
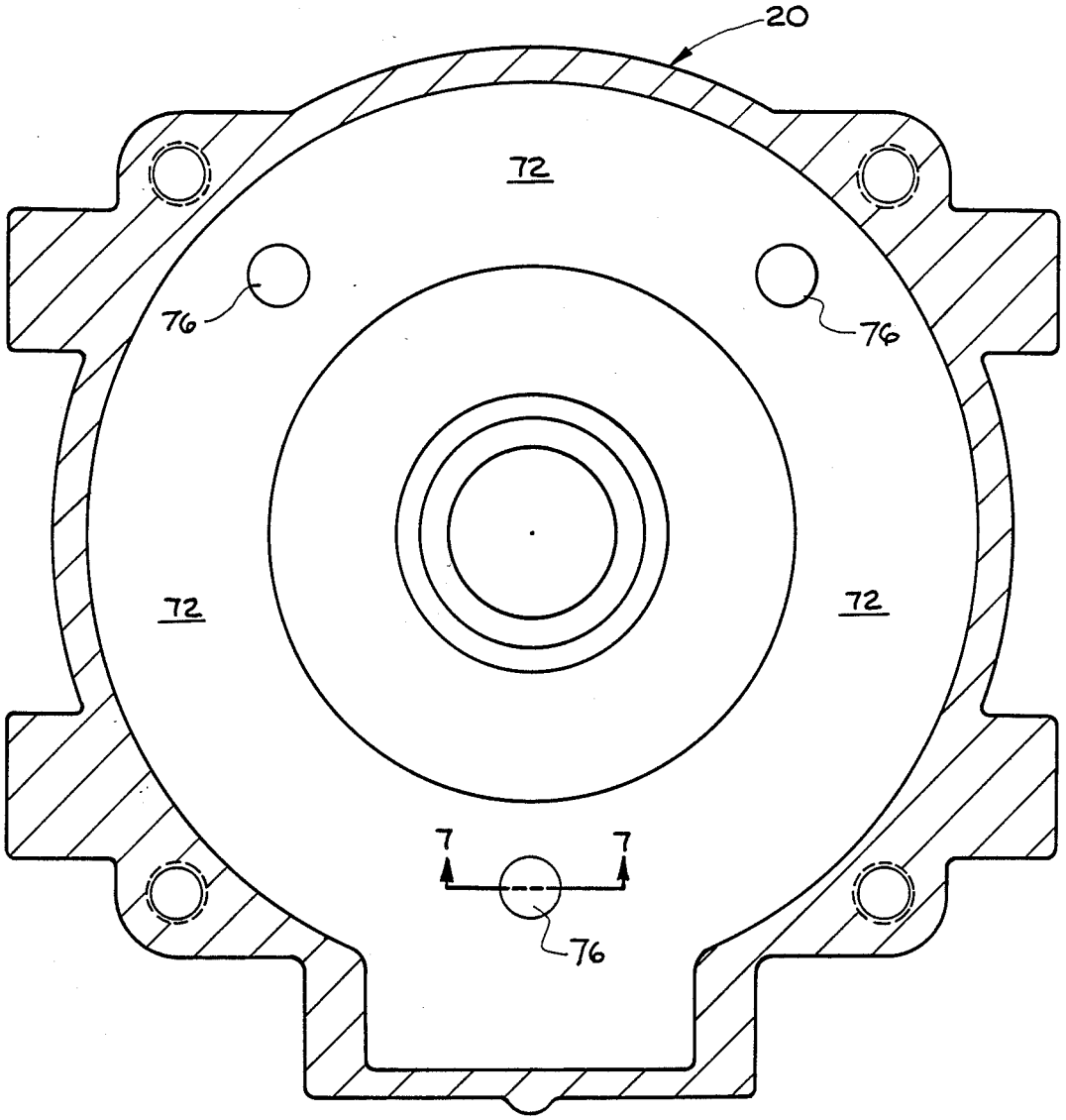
FIG. 6 is a plan view of the housing with the remaining pump structure removed.
Figure 7:
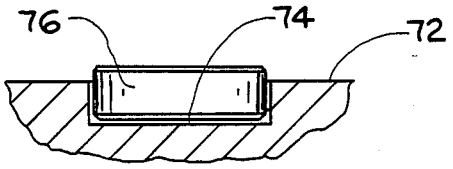
FIG. 7 is a sectional view to an enlarged scale taken along lines 7—7 of FIG. 6.

Cam ring 18 is held between back plate 16 and housing retaining surface 72, as seen in FIG. 2. The right side of cam ring 18 actually rides on three glass-filled Nylon pads 76, as shown in FIGS. 6 and 7. Located in the retaining surface 72 of the housing 20 are three shallow pockets 74 which each receive a pad 76. The pads extend out from surface 72 into contact with the cam ring 18. The pads are free to float in the pockets 74 and provide a cushioning and shimming function for the lateral positioning of the cam ring. The pads reduce noise and wear between ring 18 and housing 20 which is constructed of a softer metal such as aluminum.

Positioning the cylinder block 12 on its stationary pintle 14 so that the various valving ports are properly aligned as achieved by hydraulic pressure which acts on the back plate side of the cylinder block 12 and holds the block against the drive plate and drive shaft 26 and 14 respectively. Other methods of maintaining cylinder block alignment with its pintle have been by either close tolerance fit of all the parts; grooves in the cam ring, or other mechanical means. In the pump structure of the present invention, as the pump builds pressure, there is a certain leakage flow between the bearing surface on the pintle 14 and the inside diameter of the cylinder block 12. In looking at FIG. 2, this leakage flow exits on both sides of the cylinder block with the flow on the left side flowing between the back plate 16 and the cylinder block 12 in a very narrow space A, which is exaggerated in the drawing. The leakage flow on the opposite side of the block builds no pressure since it flows directly into the large space of drive slot 28, as seen in FIG. 4. The leakage flow on the left side of the cylinder block through passage A is restricted and therefore maintains a degree of pressure until it reaches the outer edge of the cylinder block, and this pressure creates a force on the cylinder block 12 urging it to the right against drive plate 26 and drive shaft 24. This lateral force is carried by bearing 86 through drive plate 26, and drive shaft 24. The alignment of the porting between the cylinder block 12 and the slots 46 and 48 in the pintle 14 are thereby accurately maintained.

Having described the invention with sufficient clarity to enable those familiar with the art to construct and use it, we claim:

1. In a hydraulic radial piston power transmitting assembly having:

- a housing, a back plate connected to the housing having a fixed pintle attached thereto with intake and discharge ports therein;
- a cylinder block rotatably mounted on the pintle having a plurality of radially spaced cylinder bores therein connected to ports on the inside diameter of the cylinder block for porting fluid to and from the ports in the pintle, a rotating surface on the side of the cylinder block in contact with the back plate, each bore containing a reciprocating piston with a slipper shoe connected thereto;
- a cam ring surrounding the cylinder block in a non-concentric position for stroking the pistons and slipper shoes in and out of the cylinder block;
- a drive shaft with a thrust bearing thereon passing through the housing; and
- a coupling means connecting the drive shaft to the cylinder block positioned between the cylinder block and the drive shaft limiting the lateral movement of the cylinder block away from the back plate whereby the leakage oil flow between the pintle and inside diameter of the cylinder block creates a hydraulic force between the back plate and the cylinder block urging the cylinder block away from the back plate into contact with the coupling means for correct positioning of the cylinder block ports with the pintle ports.

2. In a hydraulic radial piston power transmitting assembly as set forth in claim 1, wherein the coupling means has limited area contact with the cylinder block whereby said leakage oil on the coupling side of the cylinder block creates less hydraulic force against the cylinder block than the force created on the opposite side of the cylinder block.

3. In a hydraulic radial piston power transmitting assembly as set forth in claim 1, wherein the coupling means is an oldham coupling and has limited area contact with the cylinder block whereby said leakage oil on the coupling side of the cylinder block creates less hydraulic force against the cylinder block than the force created on the opposite side of the cylinder block.

4. In a hydraulic radial piston power transmitting assembly having:

a housing, a back plate connected to the housing having a fixed pintle attached thereto with intake and discharge ports therein;

a cylinder block rotatably mounted on the pintle having a plurality of radially spaced cylinder bores therein connected to the inside diameter of the cylinder block, each bore containing reciprocating pistons with a slipper shoe connected thereto;

a drive shaft passing through the housing;

a coupling means connecting the drive shaft to the cylinder block;

a cam ring surrounding the cylinder block and pistons pivotally connected to the housing allowing limited movement of the ring to vary the piston stroke in the cylinder block, the improvement comprising lateral cam ring positioning means including:

a retaining surface in said housing parallel to the back plate and defining therebetween a space to receive and contain the cam ring, a plurality of shallow pockets in the retaining surface adjacent the cam ring and a plurality of non-metallic pads positioned in said pockets, the pads having a thickness greater than the pockets whereby the cam ring rides between the pads and the back plate to minimize noise and wear.

5. In a hydraulic radial piston power transmitting assembly as set forth in claim 4, wherein the pads are sized to float freely in the pockets and the pockets are equally spaced around the housing.

6. In a hydraulic radial piston power transmitting assembly as set forth in claim 4, wherein the pads are glass-filled Nylon and there are three pads and corresponding pockets.

7. In a hydraulic radial piston power transmitting assembly having:

a housing, a back plate connected to the housing having a fixed pintle attached thereto with intake and discharge ports therein;

a cylinder block rotatably mounted on the pintle having a plurality of radially spaced cylinder bores therein connected to the inside diameter of the cylinder block, each bore containing reciprocating pistons with a slipper shoe connected thereto;

a drive shaft passing through the housing;

a coupling means connecting the drive shaft to the cylinder block;

a cam ring surrounding the cylinder block and pistons, pivotally connected to the housing allowing limited movement of the ring to vary the piston stroke in the cylinder block, the improvement comprising cam ring positioning means including:

a control arm means rotatably mounted in said assembly;

a swivel means anchored to the cam ring having a spherical surface thereon for positioning the cam ring and controlling the displacement of the assembly; and a sleeve means slidably received on the control arm means and including a lateral bore for sliding receipt of said spherical surface of the swivel means whereby the swivel means pivots about the center of its arcuate surface and slides linearly in the lateral bore to accommodate the locus of points which define the cam ring's various displacement positions.

8. In a hydraulic radial piston power transmitting assembly as set forth in claim 7, wherein the control arm means includes a dowel pin laterally extending from the control arm and the sleeve means is received on said dowel pin.

9. In a hydraulic radial piston power transmitting assembly as set forth in claim 7, wherein the control arm means includes a dowel pin laterally extending from the control arm and the sleeve means is received on said dowel pin, and the swivel means comprises a pin having a partially spherical surface approximate the end thereof.

10. In a hydraulic radial piston power transmitting assembly as set forth in claim 7, wherein the control arm means includes a dowl pin laterally extending from the control arm and the sleeve means is received on said dowel pin, the swivel means comprises a pin having a partially spherical surface with the diameter approximate that of said lateral bore.

* * * * *